United States Patent [19]

Onal

[11] Patent Number: 4,533,294

[45] Date of Patent: Aug. 6, 1985

[54] HIGH SPEED CENTRIFUGAL PUMP AND METHOD FOR OPERATING SAME AT REDUCED NOISE LEVELS

[75] Inventor: Hasan F. Onal, Denver, Colo.

[73] Assignee: Dresser Industries, Inc., Dallas, Tex.

[21] Appl. No.: 506,150

[22] Filed: Jun. 20, 1983

Related U.S. Application Data

[62] Division of Ser. No. 190,754, Sep. 25, 1980, Pat. No. 4,389,160.

[51] Int. Cl.[3] ..... F01D 5/08; F01D 5/02

[52] U.S. Cl. ..... 415/119; 415/122 R; 415/213 R

[58] Field of Search ..... 415/122 R, 219 C, 119, 415/206, 213 R, 186 R, 209, 180; 416/186 R

[56] References Cited

U.S. PATENT DOCUMENTS

| | | | |
|---|---|---|---|
| 2,882,829 | 4/1959 | Wade | 416/186 R |
| 3,217,656 | 11/1965 | Oakes | 415/180 X |
| 3,619,086 | 11/1971 | Johnson | 415/122 X |
| 3,628,881 | 12/1971 | Herrmann, Jr. | 416/186 R X |
| 3,639,080 | 2/1972 | Yamabe | 416/186 R |
| 3,717,418 | 2/1973 | Pilarczyk | 415/219 C |
| 3,776,664 | 12/1973 | Kimmel | 416/186 R UX |
| 3,809,493 | 5/1974 | Pilarczyk | 415/122 R X |
| 3,874,819 | 4/1975 | Tamura et al. | 416/186 R |
| 3,930,747 | 1/1976 | Woollenweber | 415/205 |

FOREIGN PATENT DOCUMENTS

| | | | |
|---|---|---|---|
| 610726 | 3/1935 | Fed. Rep. of Germany | 415/209 |
| 691676 | 10/1930 | France | 416/186 R |

*Primary Examiner*—Robert E. Garrett
*Assistant Examiner*—Joseph M. Pitko

[57] ABSTRACT

In a single stage, single suction, high speed centrifugal pump utilizing a closed Francis-vane impeller including a radially extending vane support portion having an outer discharge diameter at least approximately twice the inlet diameter of the inlet eye of the impeller, operating noise is reduced by encasing a single-step helical gear drive arrangement in a common bearing housing with the impeller's shaft. The operating noise is further reduced by forming the driven helical gear directly on the impeller's shaft to improve dynamic balance, by tensioning the shaft to reduce its vibration, and by mounting a plurality of fins on the bearing housing of the pump to absorb some of the high frequency sound wave energy of the pump and to translate a further portion of the high frequency sound wave energy into low frequency mechanical vibrations of the fins. Additional reductions in operating noise are obtained by encasing the fins within a shroud and by providing a fan to blow ambient air by the fins to disrupt the sound wave patterns emanating from the bearing housing.

12 Claims, 15 Drawing Figures

HIGH SPEED CENTRIFUGAL PUMP AND METHOD FOR OPERATING SAME AT REDUCED NOISE LEVELS

This application is a division of application Ser. No. 190,754, filed Sept. 25, 1980, now U.S. Pat. No. 4,389,160.

FIELD OF THE INVENTION

The present invention relates to a single stage, single suction, high speed centrifugal pump and a method for reducing the operating noise level of such a pump, operating at speeds up to 20,000 RPM, from about 108 decibels to about 85 decibels at a point about three feet distant from the pump.

BACKGROUND OF THE INVENTION AND PRIOR ART

A centrifugal pump is composed basically of a casing within which is rotatably mounted a driving or driven shaft that has an impeller attached to one end. Impellers used in a centrifugal pump are normally classified in one of four categories—a radial type impeller, Francis-type impeller, mixed-flow-type impeller, and axial or propeller-type impeller. In general, the highest head is obtained from a radial-type impeller centrifugal pump and the lowest head is obtained from an axial-type impeller centrifugal pump. Intermediate heads are obtained from the Francis-type or Francis-vane impeller centrifugal pump and the mixed-flow-type impeller centrifugal pump with the Francis-vane impeller centrifugal pump producing more head than is normally obtained from the mixed-flow-type impeller centrifugal pump.

In general terms, the more head obtained from a centrifugal pump corresponds with a smaller capacity being processed through the pump. Also, axial-type impeller pumps are more efficient than radial-type impeller pumps and the efficiencies of the other two types of impeller pumps lie therebetween.

Radial-type impellers produce high head and low capacity at low efficiency and prior Francis-type impellers produce low head and high capacity at high efficiency. Examples of high speed centrifugal pumps in this general area using a Francis-type impeller are shown in U.S. Pat. Nos. 3,817,653; 3,935,833; 3,953,150; 3,981,626; 4,004,541 and 4,031,844. With the pump of the present invention, radial-type head can be obtained with Francis-type efficiency. That is, the pump of the present invention operates in the radial-type zone with Francis-type efficiency.

OBJECTS OF THE INVENTION

It is an object of the present invention to provide a new and novel single stage, single suction, high speed centrifugal pump using a Francis-vane impeller and operating up to speeds of 20,000 RPM.

It is another object of this invention to provide a Francis-type impeller which is capable of producing a high head in the radial-type impeller pump zone with Francis-type efficiency.

It is an object of this invention to provide a Francis-type impeller pump in which the ratio of the outer discharge diameter of the impeller to the inlet diameter of the impeller eye is at least approximately two or more.

Another object of this invention is to provide a Francis-type impeller having means for controlling the axial thrust along the shaft upon which the impeller is mounted.

It is also an object of this invention to provide a pump as aforesaid which operates at a substantially reduced noise level.

It is an object of this invention to provide a Francis-type impeller in which the lead angle of the Francis-vanes is about $6\frac{2}{3}°$ to $7\frac{1}{2}°$ at the shroud and varies continuously to around 8° to 9° at the vane support portion.

Another object of this invention is to provide a pump as aforesaid in which each of the Francis-vanes has an angular extent of approximately 195° to 210° about the axis of the impeller.

It is another object of this invention to provide a pump as aforesaid in which the means for rotating the impeller shaft includes a single-step helical gear arrangement mounted within a common bearing housing with the shaft.

It is another object of this invention to provide an impeller as aforesaid in which the single-stage helical gear arrangement produces an inherent axial thrust on the shaft upon which the impeller is mounted and the controlling means includes means for directing this inherent axial thrust along the shaft toward the impeller.

It is another object of this invention to provide a pump as aforesaid in which the helical gear arrangement includes a bull gear and a generally U-shaped bull gear cover wherein each of the legs of the U-shaped cover has a configuration substantially corresponding to a radial section of the bull gear with the legs being disposed on opposite sides of the bull gear in a spaced relationship thereto.

It is another object of this invention to provide a pump as aforesaid in which one of a pair of wear rings is formed adjacent to the eye of the impeller and the other of the wear rings is formed adjacent to the back side of the vane support portion and the diameter of the wear ring formed adjacent the back side of said vane support portion is greater than the diameter of the other wear ring.

It is another object of this invention to provide a pump as aforesaid in which the bearing housing for the pump has a plurality of fins mounted thereon and extending outwardly therefrom and a fan to blow air by the fins whereby the bearing housing is air cooled and its noise attenuated.

Another object is to provide a pump as aforesaid with its driven shaft supported in journal-thrust bearings.

It is an object to provide a pump as aforesaid with a double volute portion in which the position of the outlet of the volute can be adjusted about the rotational axis of the impeller.

It is an object of this invention to provide several methods for reducing the operating noise level of a Francis-type impeller pump operating at speeds up to 20,000 RPM, which methods include the steps of mounting a single-step helical gear arrangement in a common bearing housing with the impeller's shaft, cutting a helical gear directly on the impeller's shaft for improved dynamic balance, mounting a plurality of fins on the bearing housing to absorb and translate some of the high frequency sound wave energy into lower frequency mechanical vibration of the fins and by disrupting the sound wave patterns emanating from the bearing housing, blowing ambien air by the fins to further disrupt the sound wave patterns emanating from the bearing housing, encasing the fins within a shroud to further decrease the noise level, and maintaining the impeller's shaft under tension whereby vibration of the shaft is reduced as is the noise produced thereby.

Additional objects as well as features and advantages of the present invention will become more apparent from the following detailed description and accompanying drawings.

SUMMARY OF THE INVENTION

This invention involves a single stage, single suction, high speed centrifugal pump utilizing a closed Francis-vane impeller which operates in the high efficiency range of a Francis-type impeller pump while producing head in the range of a radial-type impeller pump. The pump of the present invention has a pump housing with a double volute portion, a bearing housing within which is rotatably mounted the shaft of the impeller, means for rotating the impeller shaft including a single-step helical gear arrangement mounted within the same bearing housing as the impeller shaft, a closed Francis-vane impeller whose vanes have very low lead angles and which extend angularly about the rotational axis of the impeller in the range of 195° to 210°, and means for controlling the axial thrust along the impeller shaft including a pair of wear rings and at least one opening through the face of the impeller.

The pump also includes a bull gear cover for the bull gear of the single-step helical gear arrangement. This bull cover is positioned adjacent the bottom of the bull gear and helps to reduce its drag and increase the pump's efficiency. The pump of the present invention is also provided with a plurality of fins on the bearing housing and a fan which is mounted for rotation with the helical gear arrangement to drive ambient air by the fin whereby the bearing housing is air-cooled and the noise of the pump is attentuated. A shroud is also disclosed which can be positioned about the bearing housing substantially enclosing the fins for directing the ambient air by the fins. Another feature of the present pump is that the double volute portion of the pump housing is removeably mounted to the bearing housing whereby the outlet of the double volute portion can be secured to the bearing housing in a variety of pre-determined positions about the rotational axis of the impeller.

The present invention also includes several methods of reducing the noise level of the pump when it is operating at speeds up to 20,000 RPM from about 108 decibels to about 85 decibels at a point about 3 feet distant from the pump. The methods involve Francis-vane impeller pumps and include the steps of reducing the noise by encasing a single-step helical gear arrangement in a common bearing housing with the impeller's shaft, cutting a helical gear directly on the impeller's shaft for improved dynamic balance, mounting a plurality of fins on the bearing housing of the pump to help reduce the pump'noise by absorbing and translating some of the high frequency sound wave energy of the pump into low frequency mechanical vibration of the fins and by disrupting the sound wave patterns emanating from the bearing housing, blowing ambient air by the fins with a fan to further disrupt the sound wave patterns emanating from the bearing housing, encasing the fins within a shroud to further decrease the noise level, and maintaining the impeller's shaft under tension whereby vibration of the shaft is reduced as is the noise produced thereby.

DETAILED DESCRIPTION OF THE INVENTION

Figure 2:
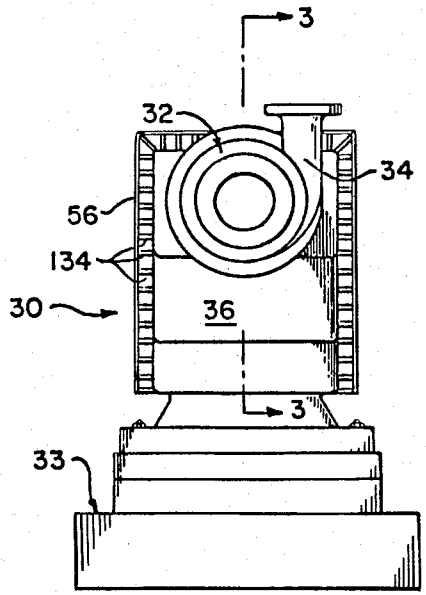
FIG. 2 is a view taken along line 2—2 of FIG. 1.
Figure 1:
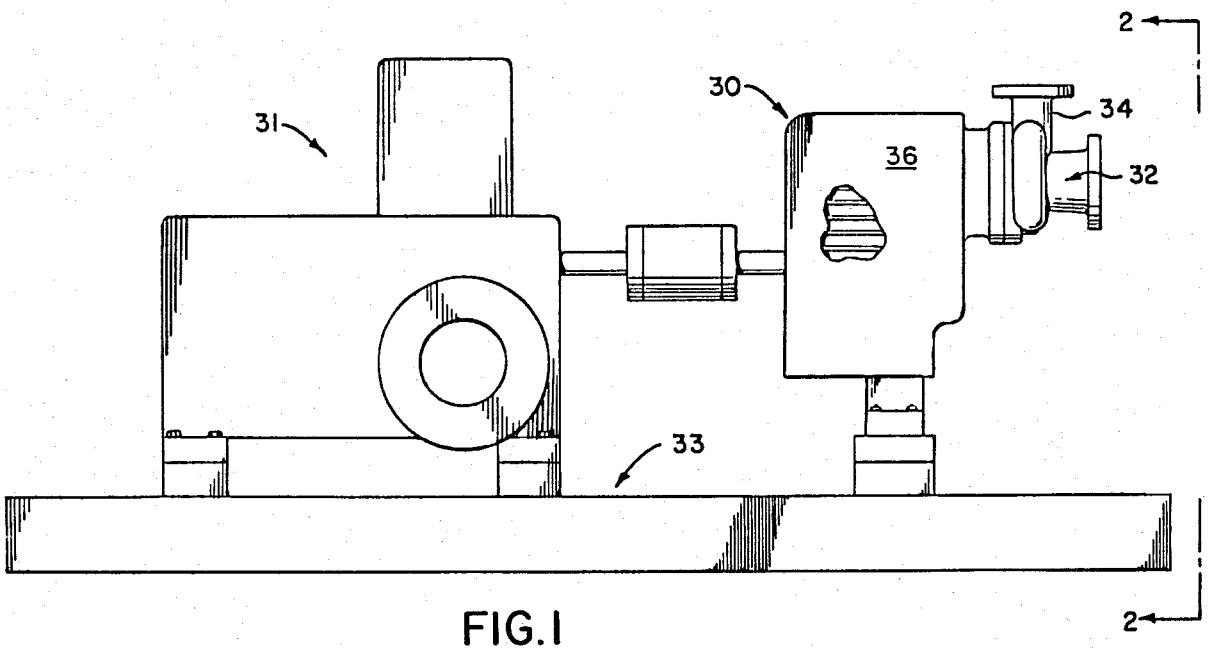
FIG. 1 is a side view, partially cut away, showing the pump of the present invention in operating relationship with its power drive and support structure therefor.
Figure 3:
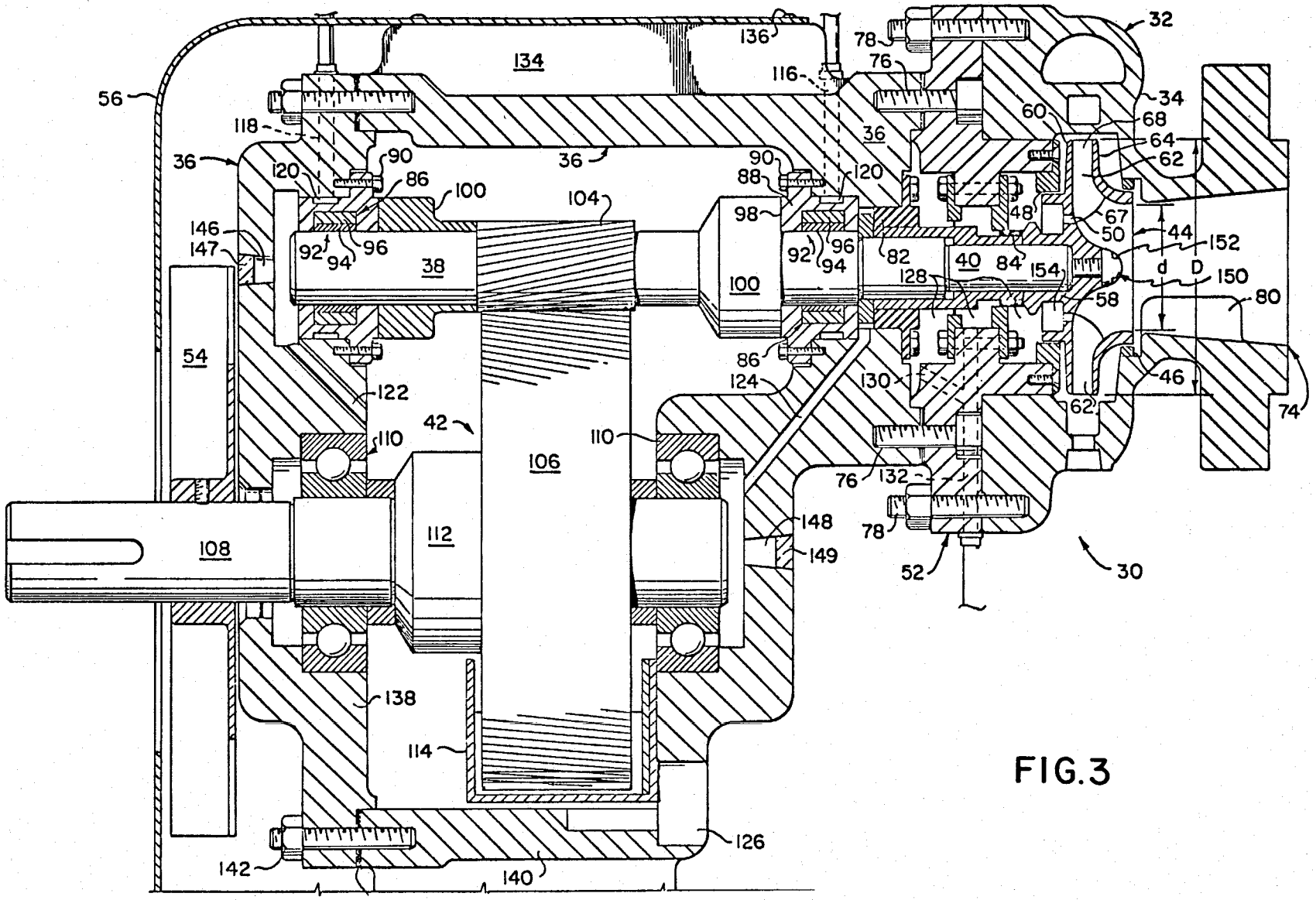
FIG. 3 is a cross-sectional view taken along line 3—3 of FIG. 2 with the outlet of the double volute rotated 90° from the position shown in FIGS. 1 and 2.

A pump 30 constructed in accordance with this invention is shown in FIGS. 1 and 2 mounted in operating relationship to its power drive 31 and the support 33. The pump 30 is a single stage, single suction, high speed centrifugal pump operating at speeds up to 20,000 RPM. Referring to FIG. 3, the pump 30 comprises a pump housing 32 including a double volute portion 34, a bearing housing 36, a shaft 38 mounted for rotation within the bearing housing 36 with a portion 40 thereof extending into the pump housing 32, drive means for rotating the shaft 38 including a single-step helical gear arrangement 42, a closed Francis-vane impeller 44 mounted on the portion 40 of the shaft 38 for rotation with the shaft 38, means for controlling the axial thrust along the shaft of 38 including a pair of wear rings 46 and 48 formed between the pump housing 32 and the impeller 44 for separating inlet pressure from the discharge pressure, a plurality of openings 50 formed through the impeller 44, adapter member 52 for interconnecting the pump housing 32 to the bearing housing 36, a cooling fan 54 and a shroud 56 encompassing the cooling fan 54 and bearing housing 36.

The Francis-vane impeller 44 of the present invention has an inlet eye with an inlet diameter d, a longitudinally extending hub portion 58, a radially extending vane support portion 60 having an outer discharge diameter D which is at least approximately twice or more than the inlet diameter d of the eye, a plurality of vanes 62, and an annular shroud 64 fixed to the vanes 62. Each of the vanes 62 and 62′ (see FIGS. 3, 7, and 10) spirals outwardly to the outer periphery of the impeller 44 and has a leading edge 67 and a trailing edge 68.

Figure 7:
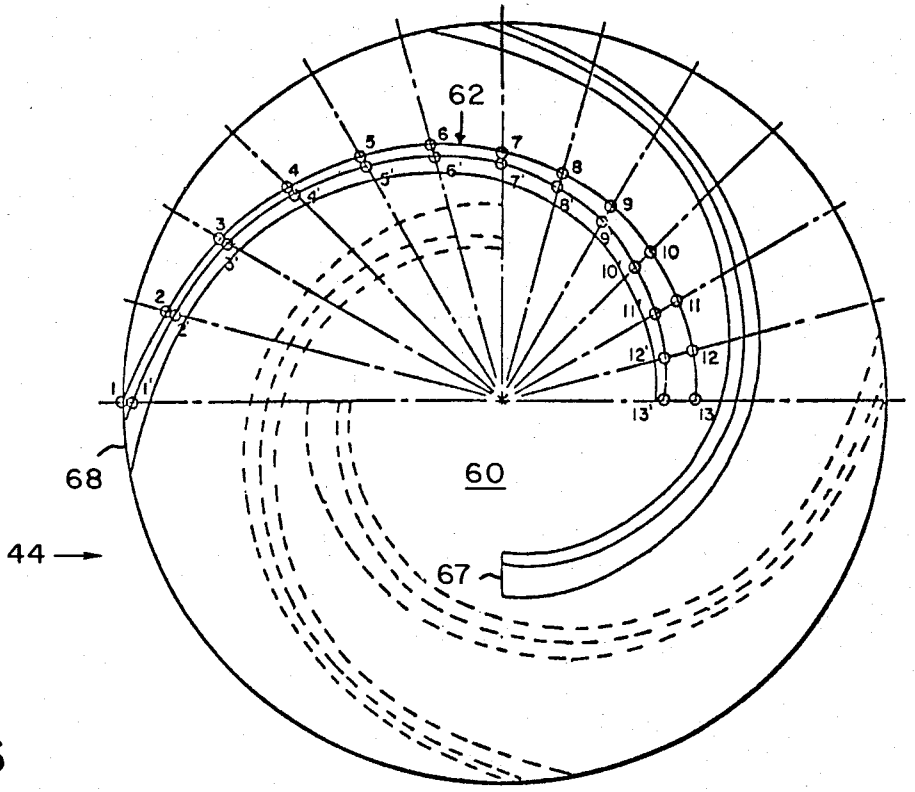
FIG. 7 shows the hydraulic layout of an impeller constructed in accordance with the present invention.
Figure 6:
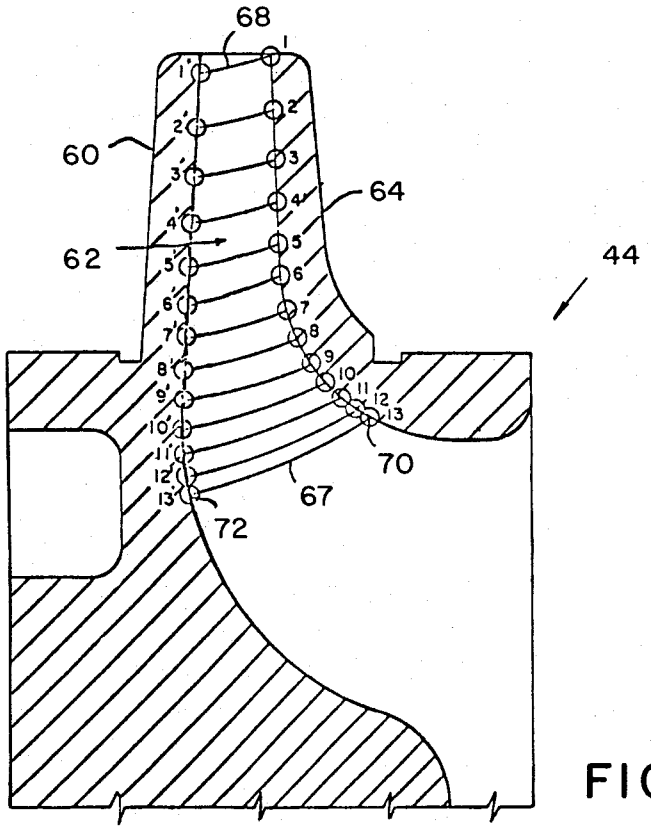
FIG. 6 is a cross-sectional profile view of an impeller and radius points of a Francis-vane constructed in accordance with the present invention.
Figure 8:
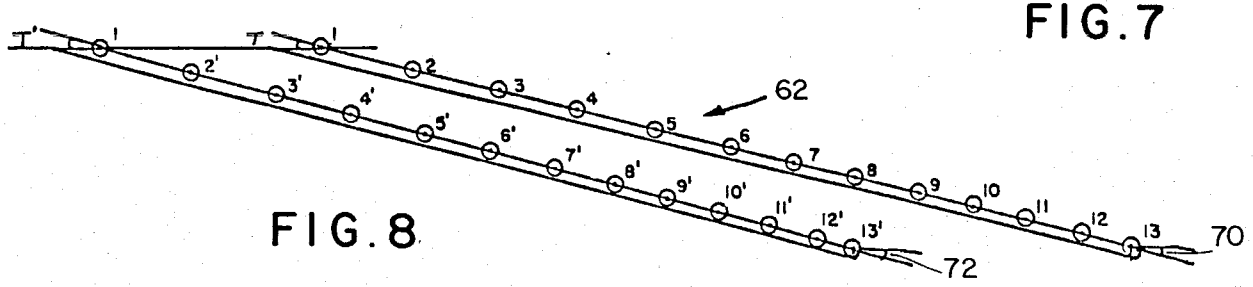
FIG. 8 is a developed view of a vane constructed in accordance with the present invention.
Figure 10:
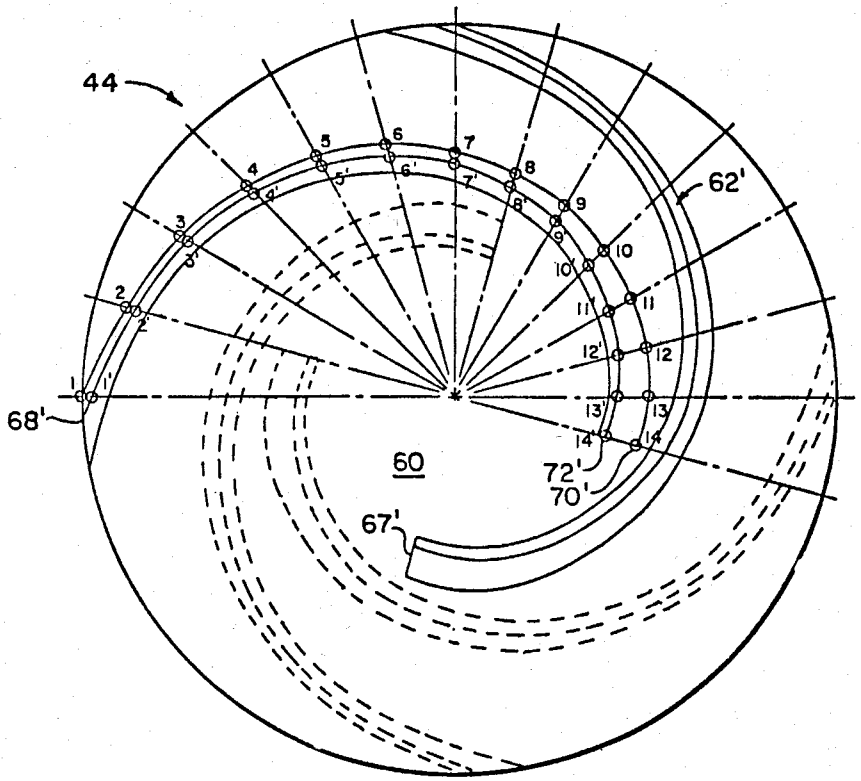
FIG. 10 shows the hydraulic layout of an impeller constructed in accordance with the present invention.
Figure 11:
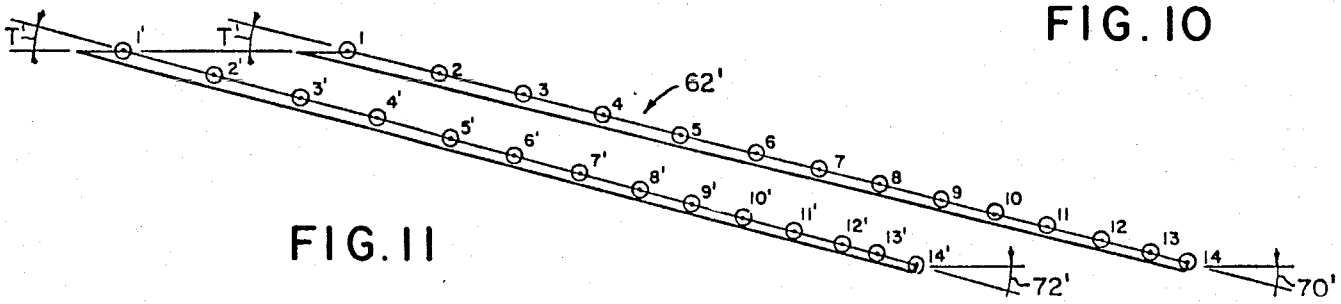
FIG. 11 is a developed view of a vane constructed in accordance with the present invention.

The lead angle at 70 in FIG. 7 of the leading edge 67 of each of the vanes 62 is about 7 degrees and 30 minutes at the shroud 64 (see FIG. 6) and varies continuously to about 9 degrees at the vane support portion 60 (see FIG. 6). The trail angle T of the trailing edge 68 of the vanes 62 shown in FIGS. 7 and 8 is about 16 degrees. Each of the vanes 62 shown in FIG. 7 has angular extent of approximately 195 degrees about the axis of the impeller 44. The lead angles 70′ and 72′ of the vanes 62′ shown in FIG. 10 are about 6 degrees 40 minutes at the shroud 64 (see FIG. 9) and varies continuously to about 8 degrees at the vane support portion 60 (see FIG. 9). The trail angle T′ of each vane 62′ shown in FIGS. 10 and 11 is about 16 degrees at the trailing edge 68′ thereof. Each of the vanes 62 shown in FIG. 10 has an angular extent of approximately 210 degrees about the axis of the impeller 44.

In prior art devices, it is standard that the ratio of the outer, discharge diameter D of the vane support structure 60 to the inlet diameter d of the eye is much smaller than 2 (see page 54 of "Centrifugal Pumps and Blowers" by Austin H. Church). However, quite surprisingly, it has been discovered that with the present invention a high speed centrifugal pump may be constructed with an impeller wherein this ratio is at least approximately 2 or more. With this discovery, it has been found that a high speed centrifugal pump may be constructed with a Francis-vane impeller which will produce a greater amount of head (in the radial-type zone) than before while still maintaining the efficiency of a Francis-vane impeller.

Figure 9:
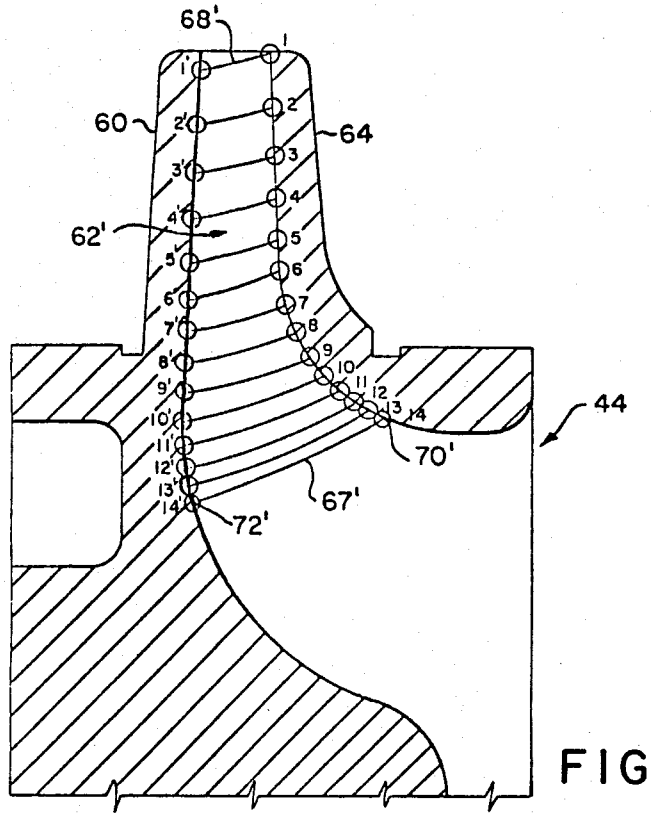
FIG. 9 is a cross-sectional profile view of an impeller and radius points of a Francis-vane constructed in accordance with the present invention.

In FIGS. 6–8 and corresponding FIGS. 9–11, the impeller profile, vane layout, and developed view of the vane layout are shown for vanes 62 and 62′ respectively. As shown in FIGS. 6 and 9, each of the Francis-vanes 62 and 62′ is formed with a backward curve (taken with respect to the direction of rotation of the impeller 44) and the radius of of curvature of the vane at the leading edge 67 (see FIG. 3) near the shroud 64 is less than the corresponding radius near the vane support structure 60. As previously indicated, the angular extent of each vane about the axis of the impeller is approximately 195° for vane 62 of FIGS. 6–8 and 210° for vane 62′ of FIGS. 9–11. As shown in FIGS. 7 and 10, the radius of curvature of the vanes 62 and 62′ at the shroud 64 gradually and continuously decreases relative to vane at the vane support structure 60 in a direction from the leading edge 67 to the trailing edge 68. At the trailing edge 68, the radii of curvature of the vanes 62 and 62′ at the shroud 64 and support 60 are nearly equal. As previously indicated, the lead angles 70, 70′, 72, and 72′ of the leading edges 67 and 67′ are substantially smaller than the trail angles T and T′ respectively. A graphical depiction of the change in the amount of this angle is shown in FIGS. 7 and 8 for vane 62 and FIGS. 10 and 11 for vane 62′.

In FIGS. 6 and 9, the profiles of two impellers used in the pump of the present invention are shown including the corresponding points of those portions of the vane immediately adjacent the shroud 64 and the vane support structure 60. The points designated with primed numerals (e.g., 1′) are located adjacent the vane support structure 60 while the corresponding points for the vane portion located immediately adjacent the shroud 64 are designated with unprimed numerals (e.g., 1). As indicated in FIGS. 7 and 10, the corresponding primed and unprimed numerals of FIGS. 6 and 9 are angularly disposed at the same position about the axis of the impeller and each set of primed and unprimed points is separated from the adjacent one by 15° about the axis of the impeller. FIGS. 8 and 11 also depict the relative thickness of the vanes 62 and 62′. For example, the vanes 62′ in FIG. 11 have a thickness at the leading edge of approximately 0.23 centimeters (0.09 inches) and the thickness of the vanes gradually increases from 0.23 centimeters to about 0.33 centimeters (0.13 inches) at the trailing edge. Another example of a preferred dimension is the diameter of the impeller eye in FIG. 10 which is 5.87 centimeters (2.31 inches). With such dimensions, the net area of the impeller eye as well as the velocity and clarity of flow past the vanes may be determined. Once these calculations are made, the performance of the pump can be predicted using a Francis-vane impeller like that shown in FIGS. 6–8 or 9–11.

Figure 13:
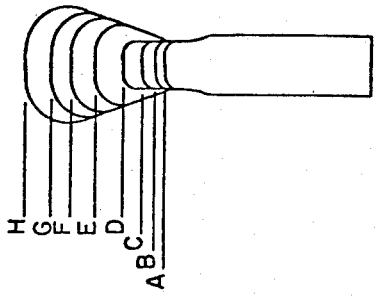
FIG. 13 shows the cross-sectional area of the double volute portion of the pump at the angular position A–H, shown in FIG. 12.
Figure 12:
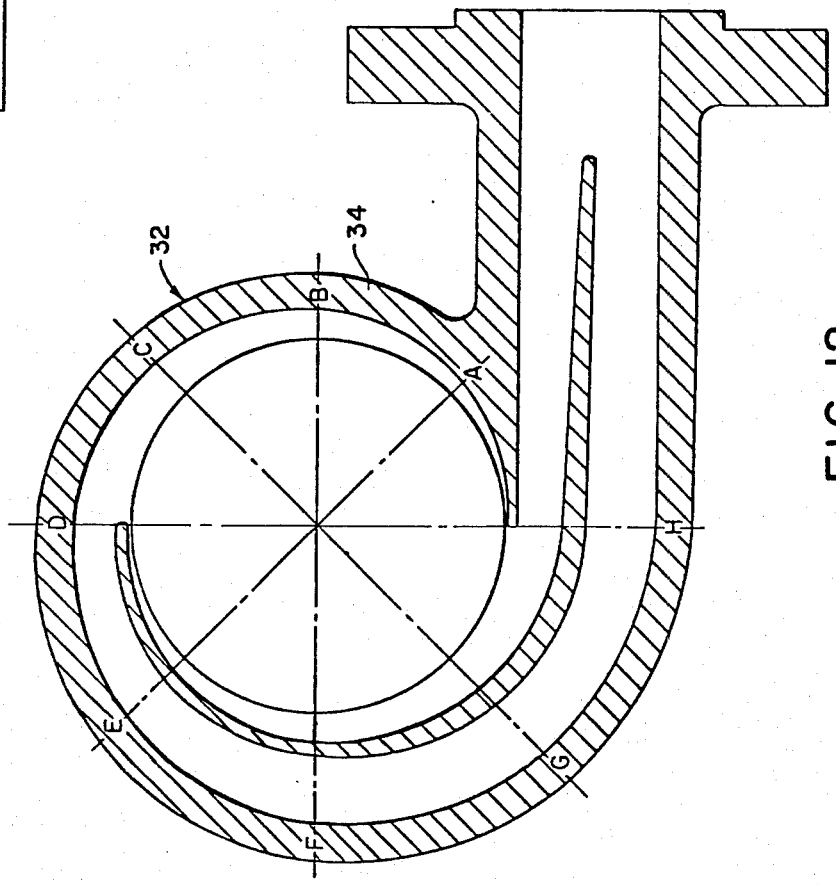
FIG. 12 shows the double volute portion of the pump housing used in the present invention.

Referring now to FIGS. 12 and 13, the double volute portion 34 of the pump housing 32 is now described. First of all, it will be understood that the use of a double volute is important in a single stage, single suction, high speed centrifugal pump if objectionable radial thrust is to be avoided. Such radial thrust exists when any type of volute is used; however, with a double volute, the radial thrust components oppose each other and, therefore, cancel one another. In FIGS. 12 and 13, the amount of area for predetermined angular positions A–H about the double volute in FIG. 12 is graphically illustrated in FIG. 13. The double volute 34 includes an inlet flow passage access 74 (see FIG. 3) with a portion thereof axially aligned and in fluid communication with the eye of the impeller. The inlet flow passage means 74 axially aligned and in fluid communication with the eye of the impeller includes at least one radial-fin 80 (see FIG. 3) which prevents spiralling of the liquid column (i.e., prerotation) in the suction pipe (not shown) to the pump. Prerotation is usually harmful to pump operation because the liquid enters between the impeller vanes at an undesirable angle, i.e., an angle not predicted by the design of the pump. Prerotation usually lowers the net effective suction head and pump efficiency. The radial-fin 80 controls entrance conditions of the liquid column in the suction pump and serves to help prevent prerotation of the liquid column at the impeller.

The double volute portion 34 of this invention is unique in that it may be mounted at any angular position with respect to the pump. Referring to FIG. 3, it will be noted that an adapter member 52 is secured by a plurality of screws 76 to one end of the bearing housing 36. The double volute portion 34 is, in turn, secured by a plurality of threaded member 78 to the adapter member 52. Upon loosing the screw members 78, it will be readily noted that the double volute portion 34 may be angularly rotated to any one of several angular positions about the axis of the impeller and then quickly and securely reattached to the adapter member 52 without effecting in any manner the lack of radial thrust being imposed upon the pump.

Referring now to FIG. 3, it will be noted that the pump shown includes an oil seal 82 and a product seal 84. The oil seal 82 prevents escape or leakage of the oil or lubricant from the interior of the bearing house 36 to the impeller 44. The product seal 84 is spring loaded (not shown) to prevent escape or leakage of the product being processed through the pump from the impeller into the interior of the bearing housing 36.

The shaft 38 is supported within a pair of thrust-journal bearings 86. Each of the bearings 86 include a bearing block 88 which is attached by a plurality of screws 90 to the bearing housing 36. Within each bearing block 88 is mounted a journal bearing 92 which includes a bearing portion 94 and a support portion 96. Each thrust-journal bearing 86 also includes a thrust bearing surface 98 on bearing block 88 against which thrust collar 100 abuts. By properly dimensioning the axial lengths of the thrust collars 100, it is possible to control in a precise manner the amount of axial movement permitted by the shaft 38 before the thrust collars function to transmit thrust from the shaft 38 to the bearing block 88. By cutting the gear part 104 on the high speed shaft 38 as opposed to, for examples, freezing or keying it on the shaft 38, it is possible to achieve a high degree of dynamic balance and thereby contribute to a reduction in the vibration and noise level during operation of the pump, especially at high speeds.

Figure 15:
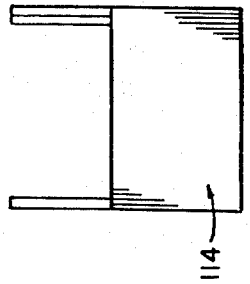
FIG. 15 is an end elevation view of the bull gear cover shown in FIG. 3.
Figure 14:
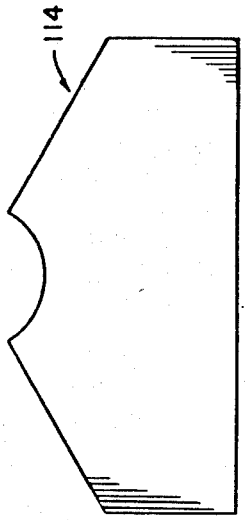
FIG. 14 is a side elevation view of the bull gear cover shown in FIG. 3.

As best seen on FIG. 3, drive means for the shaft 38 includes a single-step helical gear arrangement 42 mounted within the bearing housing 36. The single-step helical gear arrangement 42 includes a gear part 104 cut on the shaft 38 and a bull gear 106 mounted upon a second shaft 108. The second shaft 108 is mounted on the bearing housing 36 by a pair of ball bearing members 110. A thrust collar 112 is also mounted on shaft 108. A lower peripheral portion of the bull gear 106 is encased by a generally U-shaped bull gear cover 114 (see FIGS. 3, 14, and 15) which is securely attached to a portion of the bearing housing 36 by any suitable means such as by removable bolts. As shown in FIG. 3, the bull gear 106 extend into the lower portion of the bearing housing 36. By positioning the bull gear cover in the manner shown in FIG. 3, it is possible to maintain adequate lubrication of the single-step helical gear arrangement without "flooding" the arrangement with an excess of oil or lubrication. This enhances the overall efficiency of the pump by reducing drag on the bull gear 106.

The manner of lubricating the thrust-journal bearings 86 and the ball bearings 110 will now be described. Oil or lubrication is supplied from a pressurized source (not shown) through lubricant supply lines 116 and 118 (see FIG. 3). The oil or lubricant is delivered to an annular chamber 120 between the thrust-journal bearing 86 and a portion of the bearing housing 36. The oil or lubricant is transmitted from the annular chamber 120 to the bearing portion 94 of the journal bearing 92. The oil or lubrication is then passed to the ball bearings 110 via oil or lubricant supply passages 122 and 124. The oil or lubricant exiting from the oil supply passages 122 and 124 is splashed upon the ball bearing 110 and then collected within the bull gear cover 114 and, also, within the bottom of the bearing housing 36. That portion of the oil or lubricant which collects within the bull gear cover 114 is transmitted, through rotation of the bull gear 106, to the gear part 104 and then either falls back into the bull gear cover 114 or to the bottom of the bearing housing 36. An oil or lubricant return line 126 then conveys the oil or lubricant back to the source for pressurizing. Although the oil seal 82 and the product seal 84 are designed to prevent escape or leakage, respectively, of the oil and the product into the chamber 128, it will be understood that oil and product will escape or leak into the chamber 128. When this occurs, the combined oil-product mixture is removed via a fluid passages 130 and 132 to waste.

As shown in FIGS. 1–3, the bearing housing 36 includes a plurality of fins 134 mounted thereon and extending outwardly therefrom. A shroud 56 encompasses the fins 134 and bearing housing 36 thereto by any suitable means such as a plurality of screws 136. The shroud 56 serves the dual purposes of not only directing the flow of air from the cooling fan 54 by the fins 134 but also attinuating the noise level of the pump by disrupting the sound wave pattern emanating from the bearing housing 36. The fins also serve to reduce the noise level by absorbing and translating some of the high frequency sound wave energy of the pump into lower frequency mechanical vibration of the fins and by also disrupting the sound wave pattern emanating from the bearing house 36.

The bearing housing 36 has a detachable plate or cover 138 which is secured to the remaining portion 140 by a plurality of screw means 142 (see FIG. 3). A seal or gasket 144 prevents leakage of the oil or lubricant contained within the bearing housing 36. The bearing housing 36 also includes test ports 146 and 148 through which instruments can be inserted to test the axial displacement thereto on shafts 38 and 108 respectively. It is contemplated that these ports would be plugged with transparent material 147 and 149 and calibrated to enable one to determine visually the axial displacement of the shaft 38 and 108. It will be understood that a bearing housing may be formed without such ports 146 and 148 and plugs 147 and 149.

Figure 5:
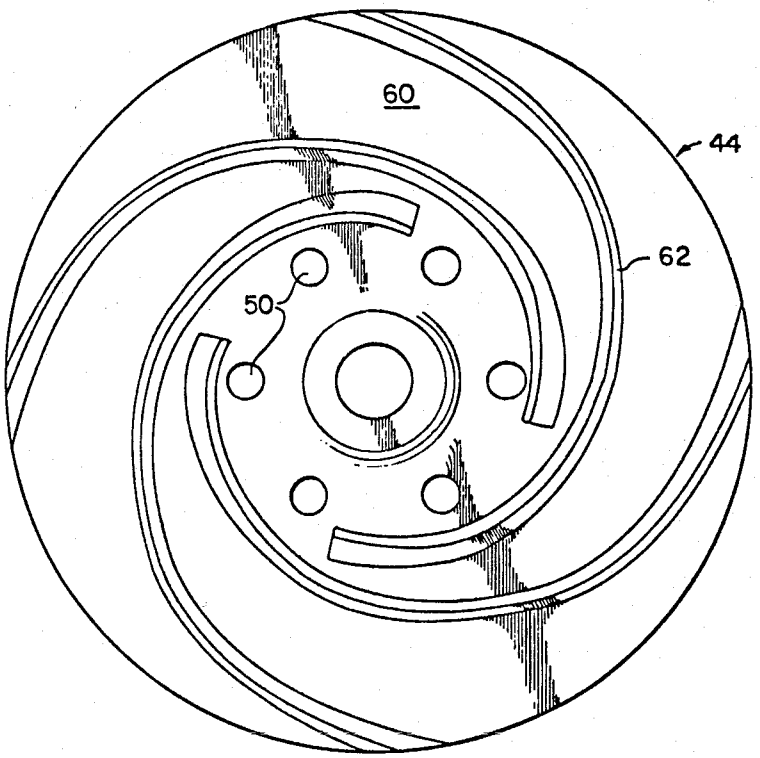
FIG. 5 is a front view along line 5—5 of FIG. 4 showing a Francis-vane impeller with the shroud removed for purposes of clarity.
Figure 4:
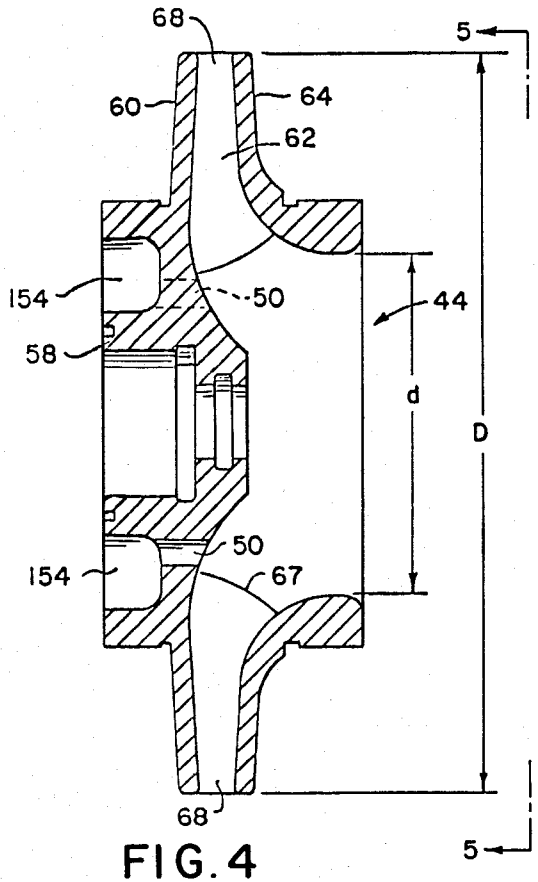
FIG. 4 is a cross-sectional view of a Francis-vane impeller used in the pump of the present invention.

The impeller 44 is securely mounted to the shaft 40 by a screw member 150 formed with a hemispherically shaped head 152 (see FIG. 3). The hemispherically shaped head 152 streamlines the flow of liquid onto the vane support structure 60 thereby reducing friction loss as the liquid passes through the impeller 44. Each of the wear rings 46 and 48 comprises a pair of oppositely threaded spiral grooves. The wear ring 46 separates the inlet pressure from the outlet pressure. As shown in FIGS. 3 and 5, the impeller 44 includes a plurality of openings 50 (e.g., six) equally spaced peripherally about the impeller for equalizing the pressure on both sides of the impeller, i.e., on the back side of the impeller within the chamber 154 and the front side of the impeller upon which are mounted the vanes 62. As also illustrated in FIG. 5, the impeller preferably has four vanes 62; however, this number can vary for certain applications to, for example, five vanes.

The single stage helical gear arrangement 42 produces an inherent axial thrust along the shaft 38 toward the right as viewed in FIG. 3. For a speed of 19,700 RPM, the amount of axial thrust produced by the helical gear arrangement 42 is constant at approximately 172 pounds. Upon determing the amount of axial thrust due to the gear arrangement 42, it is possible to further control the amount of axial thrust along the shaft 38 through the pair of wear rings 46 and 48 and the plurality of openings 50 formed through the impeller. For example, with an impeller having an outer diameter of 5 inches and a speed of 19,700 RPM with a suction pressure of 60 PSI there will be a discharge pressure of 1300 PSI. When the diameter of the impeller eye d is 2.31 inches, it will be found that where the diameter of the wear ring 46 is $3\frac{1}{4}$ inches and the diameter of the wear ring 48 is $3\frac{3}{8}$ inches, there will be a net thrust on the shaft 38 toward the right (as viewed in FIG. 3) of approximately 252 pounds. However, where the diameter of the wear ring 48 is changed from $3\frac{3}{8}$ inches to $3\frac{1}{4}$ inches, the net axial thrust to the right (as viewed in FIG. 3) on shaft 38 would be approximately 1,471 pounds. If the pump were operated at a speed of 9,750 RPM with a suction pressure of 56 PSI and a discharge pressure of 333 PSI, it will be found that for the same diameter as set forth above with respect to the speed of 19,700 RPM, a net axial thrust along the shaft 38 (toward the right as viewed in FIG. 3) will be approximately 96 pounds. Since it is highly desirable to apply a thrust in one direction along the shaft 38 for all operating conditions of the pump (while insuring again the existence of excessively large axial thrust forces), it will be noted that the foregoing can be achieved by selecting a diameter for the wear ring 48 larger than the diameter of the wear ring 46.

While several emodiments of the present invention have been described in detail herein, various changes and modification can be made without departing from the scope of the invention.

I claim:

1. A single stage, single suction, high speed centrifugal pump comprising:

(a) a pump housing, said housing including a double volute portion, (b) a bearing housing, (c) a shaft mounted for rotation within said bearing housing with a portion of said shaft extending into said pump housing, (d) means for rotating said shaft about an axis, said rotating means including a single-step helical gear arrangement, (e) a closed Francis-van impeller mounted on said portion of the shaft extending into said pump housing for rotation therewith about the rotational axis of the shaft, said impeller having:

(i) an inlet eye having an inlet diameter, (ii) a longitudinally extending hub portion and a radially extending vane support portion having an outer discharge diameter, (iii) a plurality of vanes fixed to said vane support portion, said vanes spiraling outwardly to the outer periphery of said vane support portion and having leading and trailing edges and lead and trail angles, (iv) an annular shroud fixed to said vanes, (v) the lead angle of each leading edge of said vanes being about 60°40′ at said shroud and varying continuously to about 8° at said vane support portion, (vi) the trail angle of each vane being about 16° at the trailing edge thereof, (vii) each of said vanes having an angular extent of approximately 210° about the rotational axis of the impeller, and (viii) each of said vanes being equally spaced peripherally about said impeller (f) said double volute portion of said pump housing being mounted about said impeller to receive the discharge therefrom and having an inlet flow passage means with a portion thereof axially aligned and in fluid communication with the eye of the impeller, (g) the ratio of the outer discharge diameter of said vane support portion to the inlet diameter of said impeller eye being at least approximately two, and (h) means for controlling axial thrust along said shaft, said controlling means including:

(i) a pair of wear rings of predetermined diameter relative to each other formed between the pump housing and said impeller for separating the inlet pressure from the discharge pressure, and (ii) at least one opening formed through said impeller, wherein said bearing housing includes a plurality of fins mounted thereon and extending outwardly of said bearing housing, and further including a fan mounted for rotation with said helical gear arrangement to drive ambient air by said fins whereby said bearing housing is air-cooled and the noise of said pump is attenuated.

2. The pump of claim 1 further including a shroud positioned about said bearing housing substantially enclosing said fins for directing said ambient air by said fins.

3. A single stage, single suction, high speed centrifugal pump comprising:

(a) a pump housing, said housing including a double volute portion, (b) a bearing housing, (c) a shaft mounted for rotation within said bearing housing with a portion of said shaft extending into said pump housing, (d) means for rotating said shaft about an axis, (e) a closed Francis-vane impeller mounted on said portion of the shaft extending into said pump housing for rotation therewith about the rotational or axis of the shaft, said impeller having:

(i) an inlet eye having an inlet diameter, (ii) a longitudinally extending hub portion and a radially extending vane support portion having an outer discharge diameter and a front and back side, (iii) a plurality of vanes fixed to said vane support portion, said vanes spiraling outwardly to the outer periphery of said vane support portion and having leading and trailing edges and lead and trail angles, (iv) an annular shroud fixed to said vanes, the lead angle of each leading edge of said vanes being about $6\frac{2}{3}$° to about $7\frac{1}{2}$° at said shroud an varying continuously from about 8° to about 9° at said vane support portion, (vi) each of said vanes having an angular extent of approximately 195° to 210° about the rotational axis of the impeller, and (vii) each of said vanes being equally spaced peripherally about said impeller, (f) the ratio of the outer discharge diameter of said vane support portion to the inlet diameter of said impeller eye being at least approximately two, (g) said double volute portion of said pump housing being mounted about said impeller to receive the discharge therefrom and having an inlet flow passage with a portion thereof axially aligned and in fluid communication with the eye of the impeller, and (h) means for controlling axial thrust along said shaft, said controlling means including:

(i) a pair of wear rings of predetermined diameter relative to each other formed between the pump housing and said impeller for separating the inlet pressure from the discharge pressure, and (ii) at least one opening formed through said impeller, wherein said bearing housing includes a plurality of fins mounted thereon and extending outwardly of said bearing housing, further including a fan mounted for rotation with said helical gear arrangement to drive ambient air by said fins whereby said bearing housing is air-cooled and the noise of said pump is attenuated.

4. The pump of claim 3 further including a shroud positioned about said bearing housing substantially enclosing said fins for directing said ambient air by said fins.

5. A method for reducing the operating noise level of a single stage, single suction, high speed centrifugal pump for liquids operating at speeds up to 20,000 RPM, said method including the steps of:

(a) mounting a Francis-vane impeller including a radially extending vane support portion having an outer discharge diameter at least approximately twice the inlet diameter of the inlet eye of the impeller in an overhung manner on a first portion of a shaft within a double volute pump housing, (b) rotatably mounting a second portion of said shaft within a bearing housing, (c) rotatably mounting a single-step helical gear arrangement in said bearing housing in a driving relationship with said second portion of said shaft, and (d) driving said shaft through said single-step helical gear arrangement to maintain said shaft under a predetermined tension whereby the noise level of said pump is reduced due to the shaft's final speed step up being accomplished by a gear arrangement mounted in a common bearing housing with the second portion of said shaft.

6. The method of claim 5 further including the step of cutting a helical gear directly on said second portion of said shaft for improved dynamic balance and less noise from vibration due to dynamic inbalance of the rapidly rotating shaft.

7. The method of claim 5 further including the step of blowing ambient air by said fins to further disrupt the sound wave patterns emanating from said bearing housing to further reduce the noise level thereof.

8. The method of claim 5 further including the step of substantially encasing said fins within a shroud to further decrease the noise level of said bearing housing.

9. A method for reducing the operating noise level of a single stage, single suction, high speed centrifugal pump for liquids operating at speeds up to 20,000 RPM, said method including the steps of:

(a) mounting a Francis-vane impeller including a radially extending vane support portion having an outer discharge diameter at least approximately twice the inlet diameter of the inlet eye of the impeller in an overhung manner on a first portion of a shaft within a double volute pump housing, (b) rotatably mounting a second portion of said shaft within a bearing housing, (c) mounting a plurality of fins on said bearing housing extending outwardly therefrom and along substantially the entire length of said housing whereby said fins help reduce the noise of said pump by absorbing and translating some of the high frequency sound wave energy of said pump into lower frequency mechanical vibration of said fins and by disrupting the sound wave patterns emanating from said bearing housing, and (d) driving said shaft under tension at speeds up to 20,000 RPM.

10. A method for reducing the operating noise level of a single stage, single suction, high speed centrifugal pump for liquids operating at speeds up to 20,000 RPM, said method including the steps of:

(a) mounting a Francis-vane impeller including a radially extending vane support portion having an outer discharge diameter at least approximately twice the inlet diameter of the inlet eye of the impeller in an overhung manner on a first portion of a shaft within a double volute pump housing, (b) rotatably mounting a second portion of said shaft within a bearing housing, (c) driving said shaft at speeds up to 20,000 RPM, and (d) maintaining said shaft under tension whereby vibration of said shaft is reduced as is the noise produced thereby.

11. A method for reducing the operating noise level of a single stage, single suction, high speed centrifugal pump for liquids operating at speeds up to 20,000 RPM from about 108 decibels to about 85 decibels at a point approximately three feet distant from said pump, said method including the steps of:

(a) mounting a Francis-vane impeller including a radially extending vane support portion having an outer discharge diameter at least approximately twice the inlet diameter of the inlet eye of the impeller in an overhung manner on a first portion of a shaft within a double volute pump housing, (b) rotatably mounting a second portion of said shaft within a bearing housing, (c) cutting a helical gear directly on said second portion of said shaft for improved dynamic balance and less noise from vibration due to dynamic balance and less noise from vibration due to dynamic imbalance of the rapidly rotating shaft, (d) rotatably mounting a single-step helical gear arrangement in said bearing housing in a driving relationship with said second portion of said shaft, (e) driving said shaft through said single-step helical gear arrangement whereby the noise level of said pump is reduced due to the shaft's final speed step up being accomplished by a gear arrangement mounted in a common bearing housing with the second portion of said shaft, (f) maintaining said shaft under tension whereby vibration of said shaft is reduced as is the noise produced thereby, and (g) mounting a plurality of fins on said bearing housing extending outwardly therefrom and extending along substantially the entire length of said housing whereby said fins help reduce the noise of said pump by absorbing and translating some of the high frequency sound wave energy of said pump into lower frequency mechanical vibration of said fins and by disrupting the sound wave patterns emanating from said bearing housing.

12. The method of claim 11 further including the steps of:

(h) substantially encasing said fins within a shroud to further decrease the noise level of said bearing housing, and (i) blowing ambient air by said fins to further disrupt the sound wave patterns emanating from said bearing housing to further reduce the noise level thereof.

* * * * *